United States Patent [19]

Stille

[11] Patent Number: 4,813,672

[45] Date of Patent: Mar. 21, 1989

[54] BATTERS' BOX

[76] Inventor: Harry Stille, P.O. Box 203, Due West, S.C. 29639

[21] Appl. No.: 946,369

[22] Filed: Dec. 24, 1986

[51] Int. Cl.[4] ..... A63B 71/00

[52] U.S. Cl. ..... 273/25; 405/258; 428/247

[58] Field of Search ..... 428/247, 283, 327, 240, 428/423.3, 407, 903.3; 273/25; 405/258

[56] References Cited

U.S. PATENT DOCUMENTS

| | | | |
|---|---|---|---|
| 3,801,421 | 4/1974 | Allen et al. | 428/903.3 |
| 4,492,728 | 1/1985 | Zwrkinden | 428/903.3 |
| 4,510,692 | 4/1985 | Overholser et al. | 273/25 |
| 4,666,155 | 5/1987 | Stitle | 273/25 |

*Primary Examiner*—James J. Bell

*Attorney, Agent, or Firm*—Cort Flint

[57] ABSTRACT

This invention relates to a batters' box for baseball or softball diamonds which includes a composite, laminated reinforced pad which is embedded beneath the batters' box surface by at least one inch (1") of earth. This permits the surface of the batters' box to be consistent with the surface of the surrounding area of the diamond. The composite, laminated pad prevents the batters from digging deep holes in the batters' box thereby necessitating frequent, extensive repairs for the groundskeeper. With the batters' box of the invention, the batters are permitted to establish their footing in the batters' box without being able to dig deep holes therein.

The invention also includes the method of preparing the batters' box of the invention.

12 Claims, 2 Drawing Sheets

BATTERS' BOX

BACKGROUND OF THE INVENTION

The present invention relates generally to the game of baseball or softball and more particularly to the batters' box utilized in baseball and softball.

In baseball and softball diamonds the batters' box requires continual care by the umpire and also by the groundskeepers to maintain the level of the ground within the box. Each batter, as he comes to the plate for his turn at the bat, feels it is necessary to use the spikes or cleats on his footwear to dig a hole in the batters' box to suit his own taste or disposition. As a result, each batter finds it necessary when he comes to the plate to rearrange the dirt within the batters' box. This results in substantial holes being dug within the surface of the batters' box and often requires the groundskeeper to come repair the batters' box in the midst of games.

Attempts have been made to provide artificial surfaces for the batters' box which will give the batter good frictional footing, but which will not permit the batter to dig holes in the batters' box. One such accessory or surface is found in U.S. Pat. No. 3,813,097. In this patent, the batters' box surface is made of hard, automobile, tire-like rubber which is placed flush with the playing surface and staked in place. White foul lines are molded or added to the surface and the entire surface fits within the regulation twenty-six foot (26') dirt circle when placed in alignment with the baseball field diamond boundary. The surface of the batters' box, as disclosed in this patent, presents two problems which prohibit its utilization in an actual game. The first drawback is that the surface does not permit the batter to engage his spikes into the surface at all and thereby makes it uncomfortable and sometimes unsafe for the batter utilizing such surface. A more serious objection, however, results when runners are coming to the plate during a close play which requires them to slide in order to reach the plate without being tagged by the catcher. With the use of the hard, rubber surface disclosed in this patent the runner is almost certain to be injured in sliding into home plate.

U.S. Pat. No. 4,492,728 discloses a sports ground covering which has a lower or cushioning layer and an upper or wear resisting coating between which there is a reinforcing iron netting. Both the upper and lower layers contain rubber chips which are produced from old automobile tires. The lower layer is additionally provided with spherical, expanded clay which gives the lower layer a particular elasticity and makes it independent of the atmospheric humidity during production of the covering. This patent is not very specific as to how the disclosed covering will be used, but it appears that the covering is designed to provide the playing surface utilized by the sportsmen playing games thereon. There is no suggestion that this material could be used on baseball diamonds or more particularly in batters' boxes on baseball or softball diamonds. It is obvious that should the covering material of this patent be utilized as the batters' box surfaces in the batters' boxes of baseball or softball diamonds it would suffer from the same drawbacks outlined above with regard to U.S. Pat. No. 3,813,097.

SUMMARY OF THE INVENTION

The present invention provides a batters' box wherein the batters and the catcher may perform as in conventional batters' boxes without resulting in the unduly or excessively deep holes which generally result from a baseball or softball game.

An object of the present invention is the provision of an improved batters' box.

Another object is to provide an improved batters' box which does not require the continual maintenance required by conventional batters' boxes.

A further object is to provide a method for making an improved batters' box.

Other objects, advantages, and novel features of the present invention will become apparent from the following description of the invention when considered in conjunction with the accompanying drawings.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
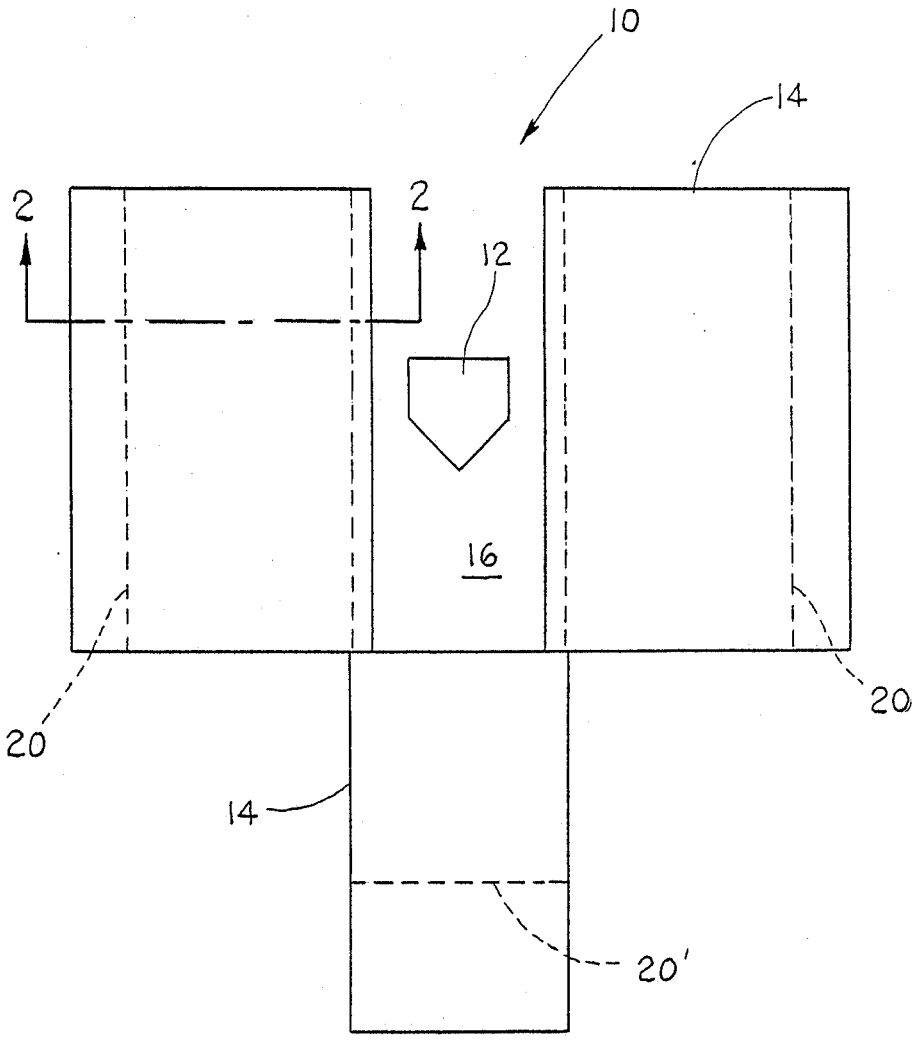
FIG. 1 is a perspective view of a batters' box constructed in accordance with the invention.

Referring now to the drawings, wherein like reference numerals designate identical or corresponding parts throughout the views. FIG. 1 shows the batters' box 10 constructed in accordance with the present invention. Batters' box 10 extends about home plate 12 and is defined by lines 14 constructed by chalk as is usual on leveled earth 16. In appearance, the batters' box 10 of FIG. 1 is identical with the conventional batters' box of the conventional baseball or softball diamond.

Figure 2:
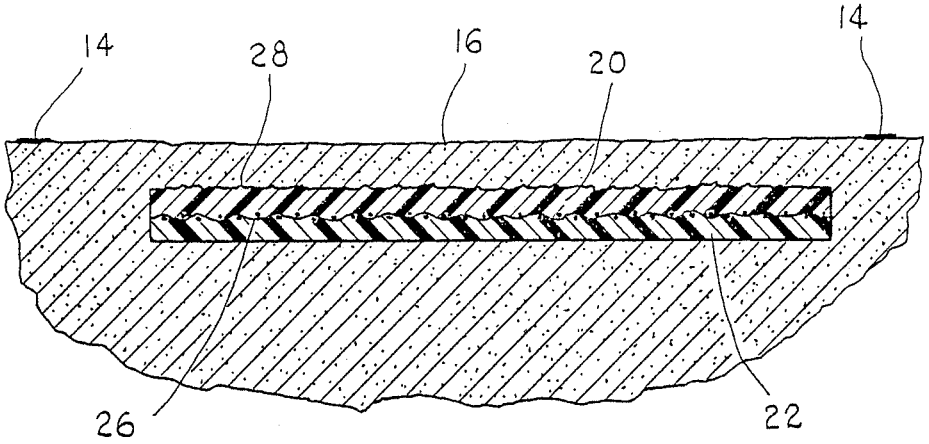
FIG. 2 is an enlarged, sectional view taken generally along line 2—2 of FIG. 1.
Figure 3:
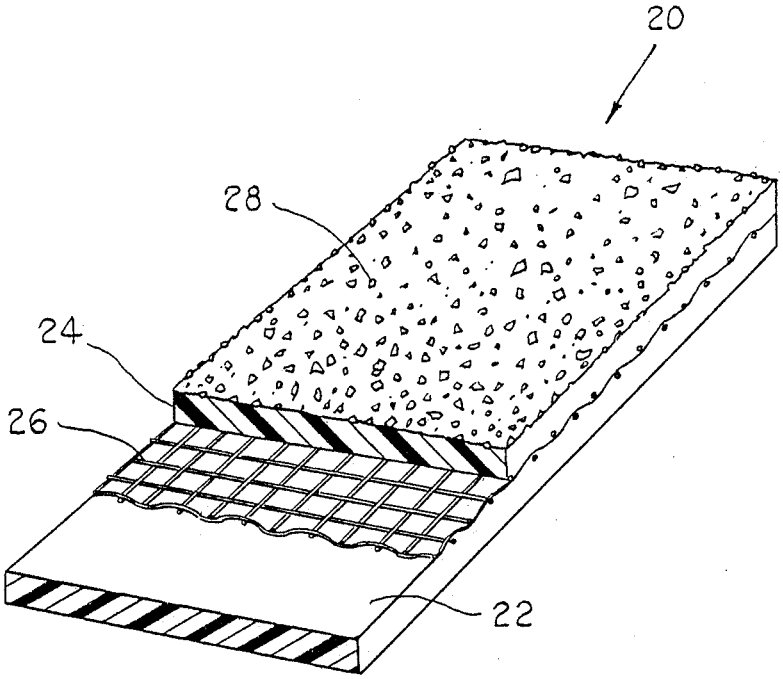
FIG. 3 is a perspective view with part broken away for clarity, of the batters' box support pad made in accordance with the present invention.

Referring now to FIG. 2, it will be seen that a batters' box elastomeric support pad 20 and 20' as can best be seen in FIG. 3, elastomeric pads 20 and 20' preferably comprise a lower layer 22 and an upper layer 24 each of which are bonded to an intermediate layer 26, are placed beneath the batters' boxes and the catchers' box. Upper layer 24 and lower layer 22 are composed of a resilient but rigid elastomeric material such as polyurethane and are bonded to each other through the intermediate layer 26 which is a woven mesh fabric which enhances the stability of the support pad. An upper friction surface 28 of the upper layer 24 of support pad 20 had incorporated into it a dry, ground, elastomeric aggregate. The inclusion of this aggregate is to give the surface of the pad a textured or roughened feel and look. This reduces slippage should spikes reach the pad through the earth. The aggregate surface also reduces spreading of the earth covering the pads.

As seen best in FIG. 2, support pad 20 is embedded in earth 26 beneath the surface of the batters' box, as illustrated in FIG. 1. Support pad 20 is embedded in the ground beneath the box and has a layer of earth 16 covering it throughout its area. The thickness of the earth covering the support pad is at least one inch (1") and may be thicker, if desired. An earth thickness of from one to two inches (1–2") is preferred. The earth thickness must not be of such a depth to permit formation of a hole above pads 20 and 21. The support pad 20 may be anchored in the earth 16 by means of anchors 30. However, it has been found that it is unnecessary to anchor the pad with such anchors and that the weight of the pad and its fitting in the depressions of the earth is adequate to maintain it in the proper position during use.

Thus, it is seen that the batters' box of the present invention comprises a layer of earth disposed on top of a laminated, composite pad which supports the layer of earth and prevents the formation of deep holes by the batters digging into the batters' box. However, the batters are still able to maintain good, frictional contact for their cleats or spikes in the layer of earth disposed ontop of the support pad. In addition, the surface of the batters' box of the invention provides no danger to runners sliding into home plate in close plays at the plate since they are free to slide in what is normally loose dirt or earth.

In producing the batters' box illustrated in FIG. 1, the first step in the production is the formation of the support pad. This pad is produced by sandwiching the intermediate layer 26 between the upper layer 24 and lower layer 22. These layers are hot-bonded together by processes well known and not forming a part of this invention. A sheet of support pad 20 is cut to less than the dimensions of the batters' box it is desired to modify in accordance with the present invention. Separate pads are cut for each batter and for the catcher. Once the support pads have been cut, the ground about the home plate is marked as to the location of the support pads and depressions are made to accommodate the support pads. This depression is dug about one inch (1") or more deeper than the thickness of the support pads. In use, applicant has found a support pad having a thickness of about three-quarters of an inch (¾") is adequate to give full support to the batters' box during use in a baseball or softball game. However, it is recognized that the thickness of the pad itself can vary as desired by the user. After the depression has been prepared, support pads 20 are placed in the depression and anchored to the earth by means of a plurality of anchors 30, if desired. However, it has been found that such anchors are not necessary in most cases. After the support pads are placed in the depressions, earth is applied to cover the support pads and to bring the level of the batters' box up to the same level as the surrounding earth. The earth of the batters' box is suitably compacted by conventional means and prepared for outlining with chalk lines 14 in the conventional manner.

EXAMPLE

An example of the batters' box of the invention for a baseball diamond has the following dimensions:

1. The chalked areas are measured as follows:
Left batters' box is six feet by four feet (6'×4').
Right batters' box is six feet by four feet (6'×4').
Catchers' box is five feet by three feet (5'×3').
2. Support pad dimensions are as follows:
Each batter's support pad is three feet by six feet (3'×6').
Catchers' support pad is three feet by three feet (3'×3').
3. Excavations of two and one-quarter inches (2¼") in depth are made so that the center of each of the batters' support pads is aligned with the center of home plate and each pad will be centered in its batters' box. The catchers support pad will have its center aligned with the center of home plate but will be placed in the area of the catchers' box nearest to the home plate and the batters' box. This will cause the batters' support pads to each abut a portion of the catchers' support pad in their excavations with a one half inch (½") overlap of each of the batters' support pads by the catchers' pad.

After the support pads are in place in their respective excavations they are covered with one and one half inches (1½") of earth, level with the surrounding playing surface of the baseball diamond.

4. The outlines of the batters' and the catchers' boxes are chalked in the usual manner to locate each batters' box six inches (6") from the respective sides of home plate and the catchers' box two and one half feet (2½') behind home plate.

A batters' box prepared in accordance with the invention as set forth herein has been found to offer all of the competitive benefits of a conventional batters' box in addition to offering durability and stability with regards to the groundkeeping chores of repairing and rebuilding the batters' box. With the present invention there are no deep holes dug deep in the batters' box which must be repaired after each game and sometimes during the course of a game.

Obviously, many modifications and variations of the present invention are possible in light of the above disclosure. It is, therefore, to be understood that the invention may be practiced otherwise than as specifically described.

While a preferred embodiment of the invention has been described using specific terms, such description is for illustrative purposes only, and it is to be understood that changes and variations may be made without departing from the spirit or scope of the following claims.

What is claimed is:

1. A method of making an earthen, artificial batters' box for an outdoor baseball or softball diamond playing field comprising the steps of:

(a) providing composite, laminated pads of elastomeric material having a roughened upper surface and area dimensions;
(b) excavating an area bout the home plate of a baseball or softball diamond to a depth of about one inch greater than the thickness of the composite, laminated pads over the entire area of the excavation;
(c) placing the prepared composite, laminated pads in said excavation;
(d) covering each said pad with a layer of earth throughout its area which is thick enough to bring the batters' box area up to the same level as the surrounding playing surface, whereby suitable traction is provided for said batters and for the catcher without permitting such players to dig deep holes in the surface of the batters' box; and
(e) outlining the area of the batters' box with white chalk around said composite, laminated pads.

2. A method of making a batters' box as set forth in claim 1, wherein the composite, laminated pad has a roughened upper surface whereby the earth is retained on said upper surface.

3. A method of making a batters' box as set forth in claim 1, wherein said composite, laminated pad has a woven, intermediate layer.

4. A method of making a batters' box as set forth in claim 1, wherein said composite, laminated pad is prepared to be less in area than the area of the batters' box outlined by chalk lines.

5. A method of making a batters' box as set forth in claim 1, wherein said composite, laminated pad is at least one-half an inch in thickness.

6. A method of making an earthen, artificial batters' box for an outdoor baseball or softball diamond playing field comprising the steps of:

(a) providing elastomeric pads having an upper friction surface and prescribed thickness and area dimensions;

(b) excavating an area about the home plate of a baseball or softball diamond to a depth of about one inch greater than the thickness of said pads over the entire area of the excavation;

(c) placing the elastomeric pads in said excavation;

(d) covering said pad with a layer of earth throughout its area which is thick enough to bring the batters' box area up to the same level as the surrounding playing surface, whereby suitable traction is provided for said batters and for the catcher without permitting such players to dig deep holes in the surface of the batters' box; and (e) outlining the area of the batters' box with white chalk around said elastomeric pads covered with earth in said excavation.

7. The method of claim 6 including providing a roughened surface on said friction surface to aid in retaining earth covering said pads.

8. An earthen, artificial batters' box having space for right-handed and left-handed batters and the catcher to stand during the play of a baseball or softball game, comprising:

(a) an excavation extending about home plate;

(b) composite, laminated pads, comprising a bottom layer of an elastomeric material and a top layer of an elastomeric material each bonded to an intermediate woven fabric disposed within said excavation;

(c) a layer of earth, at least one inch in thickness throughout its area, covering said pads; and (d) chalk lines defining the area of the batters' box said area exceeding the area of said composite, laminated pads, whereby players will be able to implant their spikes in said layer of earth without being able to dig holes in said batters' box under game conditions.

9. A batters' box as set forth in claim 6, wherein said top layers of said pads have a roughened surface to reduce spreading of said earth layer and hole formation.

10. A batters' box as set forth in claim 6, wherein said bottom layers of said composite, laminated pads are composed of polyurethane.

11. A batters' box as set forth in claim 6, wherein said composite, laminated pads are anchored to the earth by means of mechanical anchors.

12. A batters' box as set forth in claim 6, wherein said composite, laminated pads comprise top and bottom layers of polyurethane each bonded to an intermediate layer of woven fabric.

* * * * *